US007201588B2

(12) United States Patent
Nishigaki et al.

(10) Patent No.: US 7,201,588 B2
(45) Date of Patent: Apr. 10, 2007

(54) ELECTRONIC APPARATUS WITH JACK

(75) Inventors: Toshio Nishigaki, Echizen (JP); Yoshiaki Takahashi, Echizen (JP)

(73) Assignee: Orion Electric Company Ltd., Fukui-ken (JP)

( * ) Notice: Subject to any disclaimer, the term of this patent is extended or adjusted under 35 U.S.C. 154(b) by 0 days.

(21) Appl. No.: 11/385,766

(22) Filed: Mar. 22, 2006

(65) Prior Publication Data

US 2006/0216974 A1 Sep. 28, 2006

(30) Foreign Application Priority Data

Mar. 25, 2005 (JP) ..... 2005-089346

(51) Int. Cl.
*H01R 13/648* (2006.01)

(52) U.S. Cl. ..... 439/92; 439/101; 439/567; 439/609

(58) Field of Classification Search ..... 439/92, 439/101, 567, 609
See application file for complete search history.

(56) References Cited

U.S. PATENT DOCUMENTS 5,722,841 A * 3/1998 Wright ..... 439/98
6,780,029 B1 * 8/2004 Gretz ..... 439/92
6,884,094 B1 * 4/2005 Bernhart et al. ..... 439/101
6,986,673 B2 * 1/2006 de la Borbolla ..... 439/100

FOREIGN PATENT DOCUMENTS

| | | |
|---|---|---|
| JP | 08-078080 | 9/1994 |
| JP | 09-007706 | 6/1995 |
| JP | 10-172676 | 12/1996 |
| JP | 11-121105 | 10/1997 |
| JP | 11-154568 | 11/1997 |
| JP | 2002-352887 | 5/2001 |

* cited by examiner

*Primary Examiner*—Truc Nguyen
(74) *Attorney, Agent, or Firm*—Reed Smith LLP; Stanley P. Fisher, Esq.; Juan Carlos A. Marquez, Esq.

(57) ABSTRACT

A grounding wire is formed by bending a conductive wire. The grounding wire includes a winding portion formed on a horizontal portion so as to be smaller in diameter than a cylindrical portion of a jack, a horizontal proximal portion in parallel to a circuit board, and a connection end bent from an end of the horizontal proximal portion and connected to a ground pattern. The winding portion of the grounding wire is expanded and outwardly engaged to the cylindrical portion of the jack, and elastically and closely attached to the cylindrical portion of the jack by an elastic restoring force of the winding portion. The connection end is then inserted into a hole formed in the circuit board and soldered onto the ground pattern of the circuit board. Static electricity, with which the jack is charged, is discharged from the grounding wire to the ground pattern.

10 Claims, 9 Drawing Sheets

[Fig. 1]
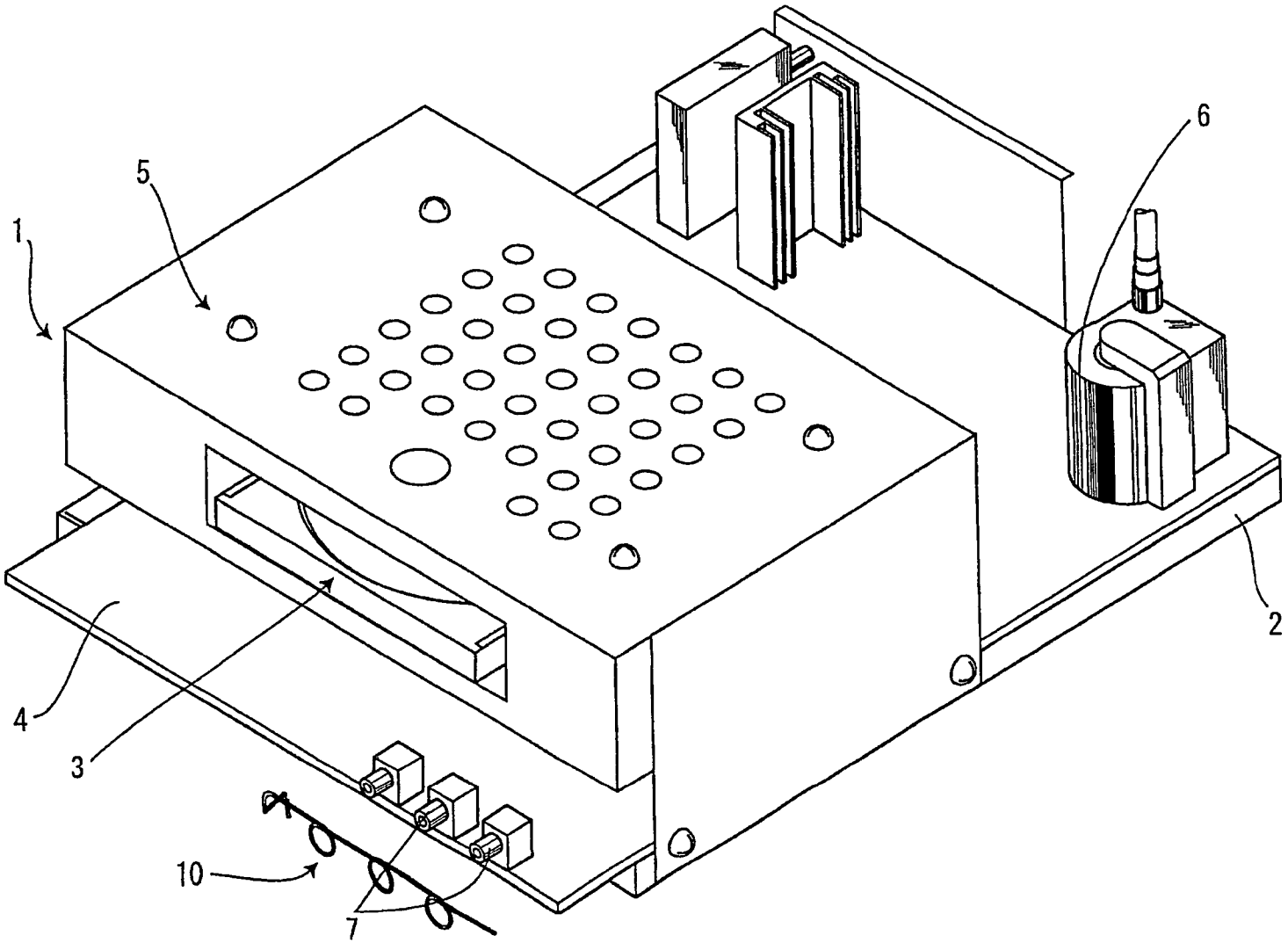

[Fig. 2]
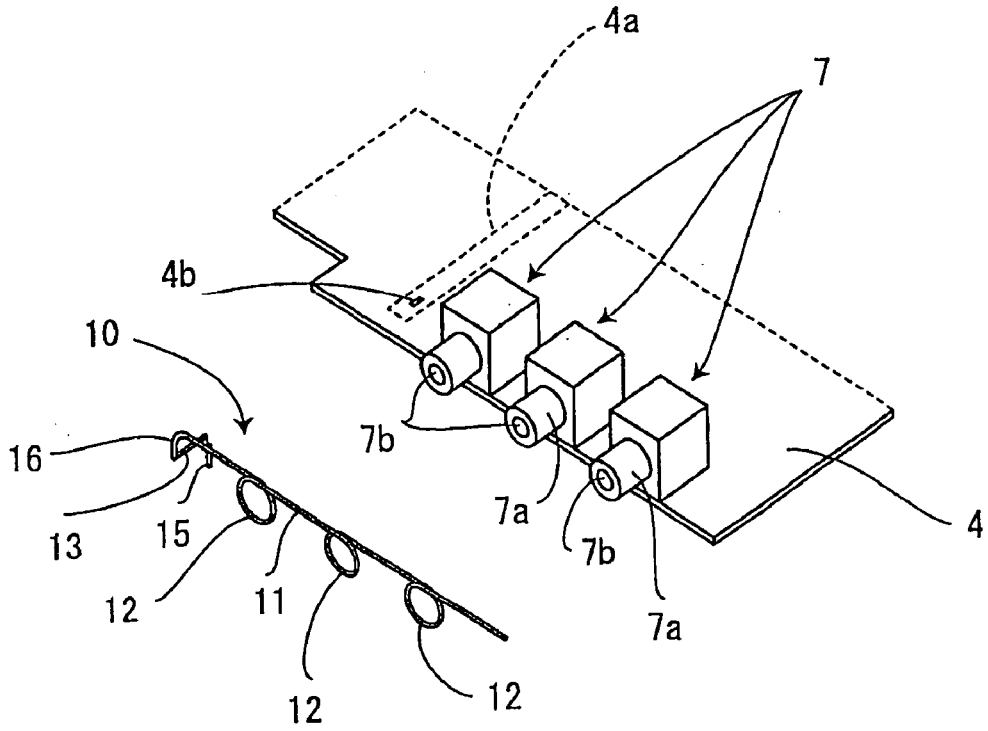
(a)
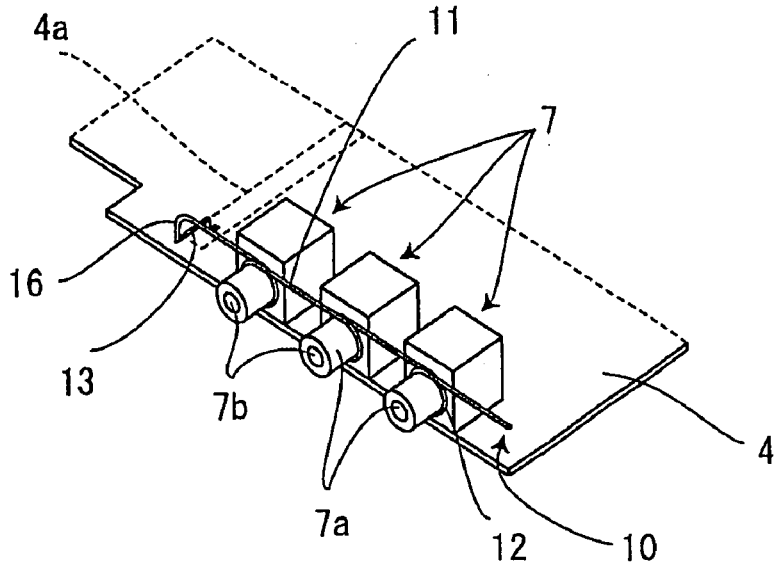
(b)

[Fig. 3]
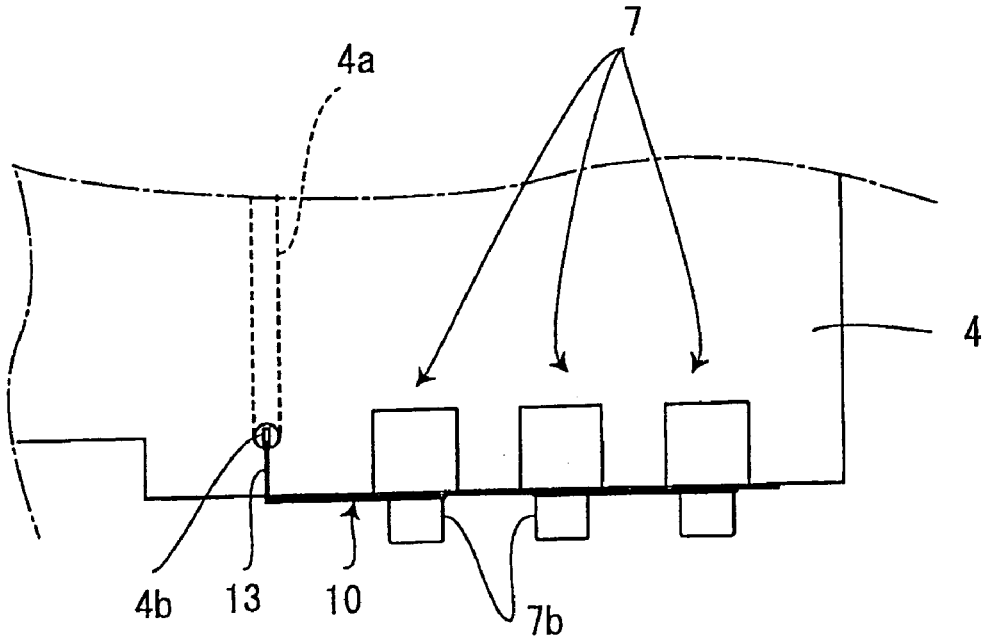
(a)
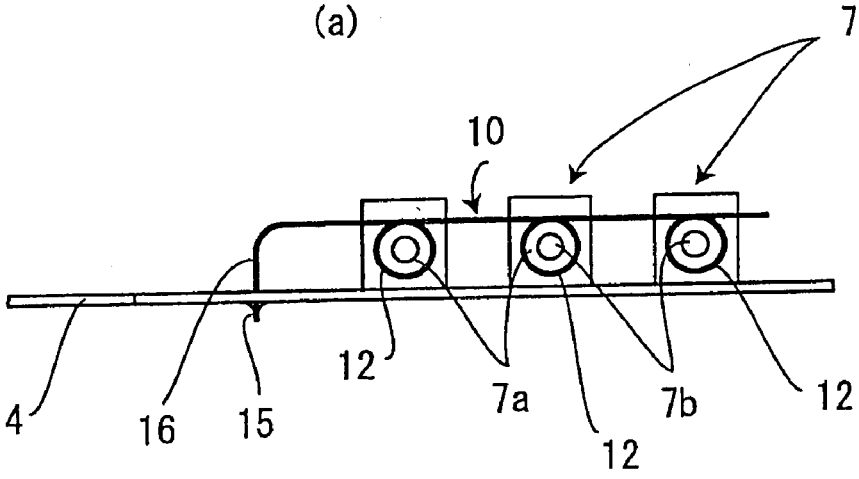
(b)

[Fig. 4]
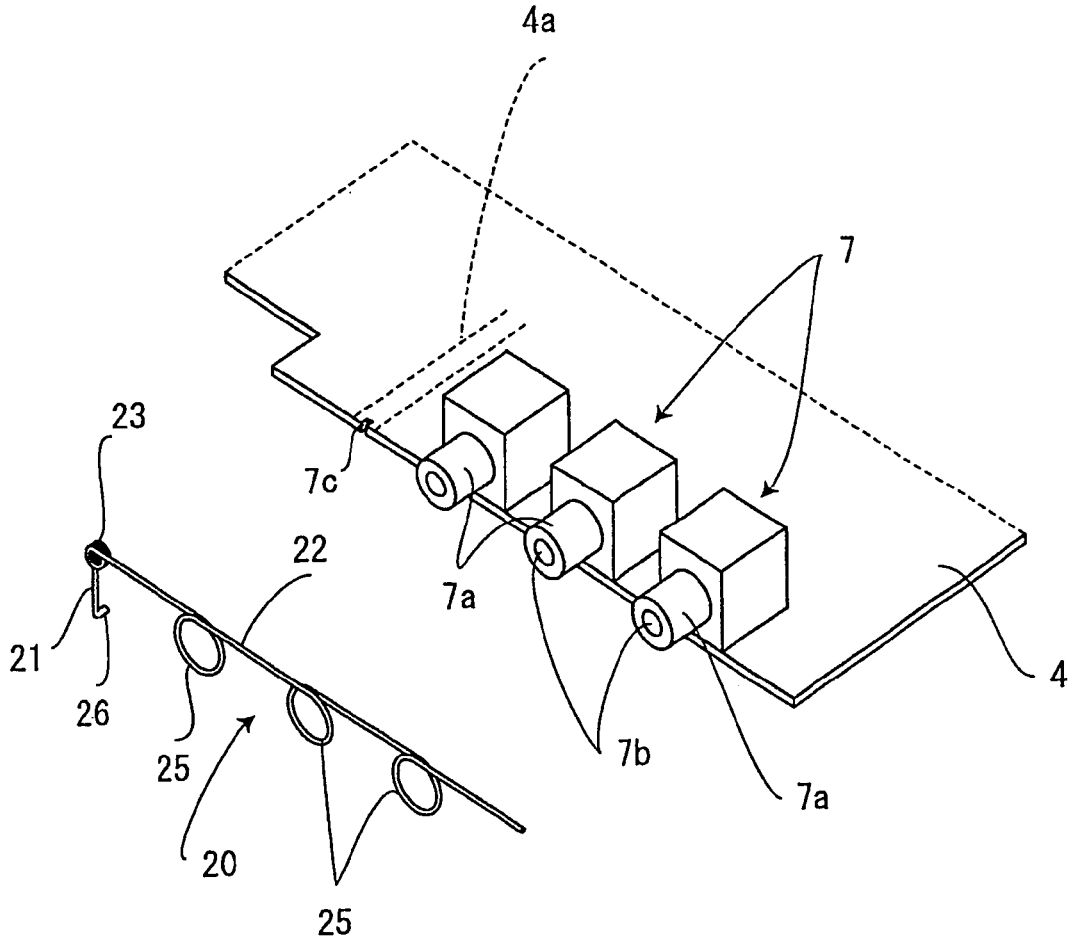

[Fig. 5]
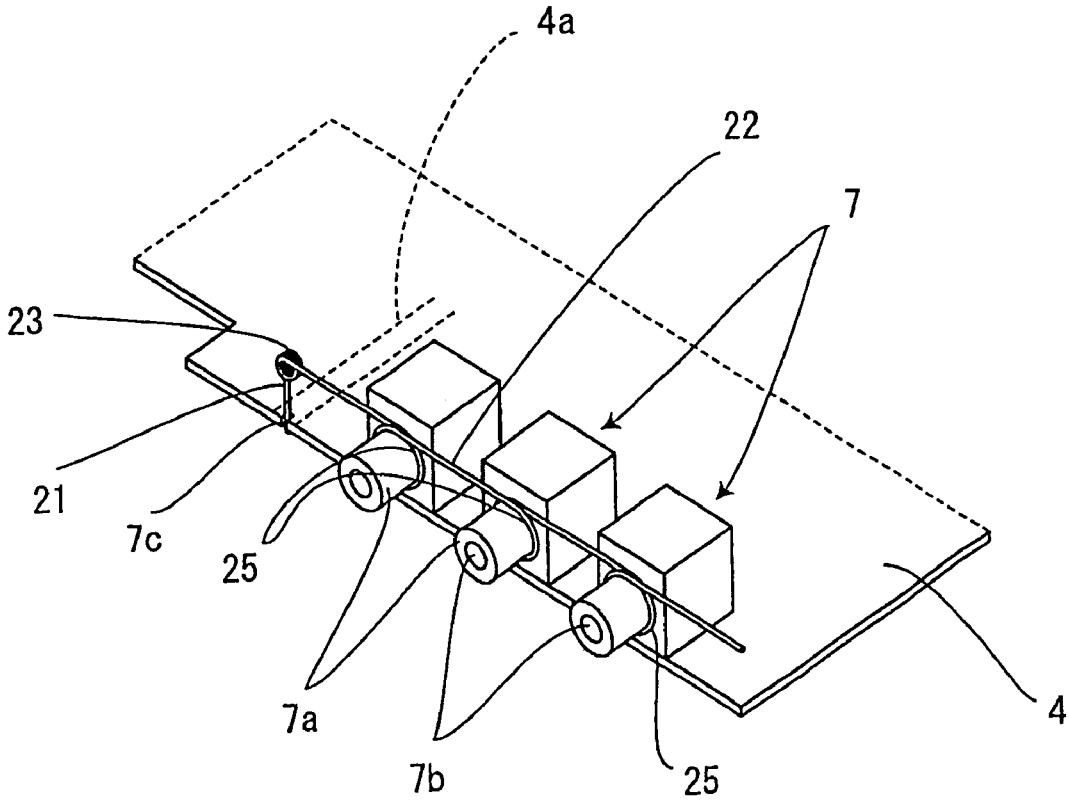

[Fig. 6]
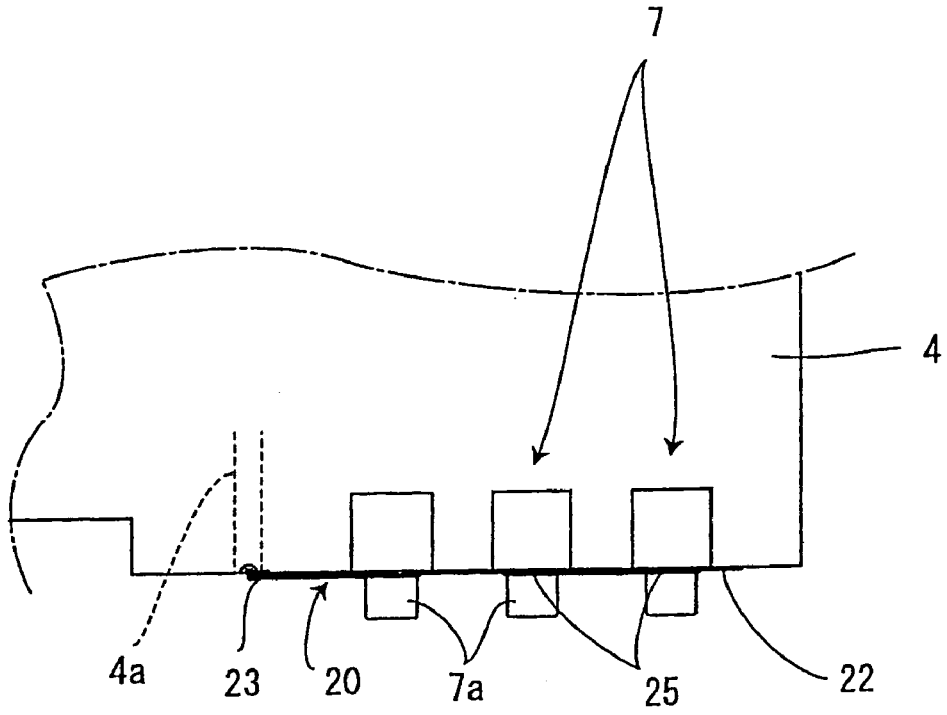
(a)
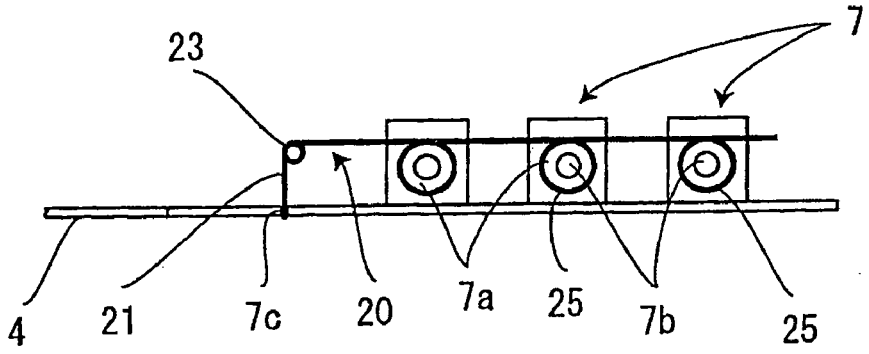
(b)

[Fig. 7]
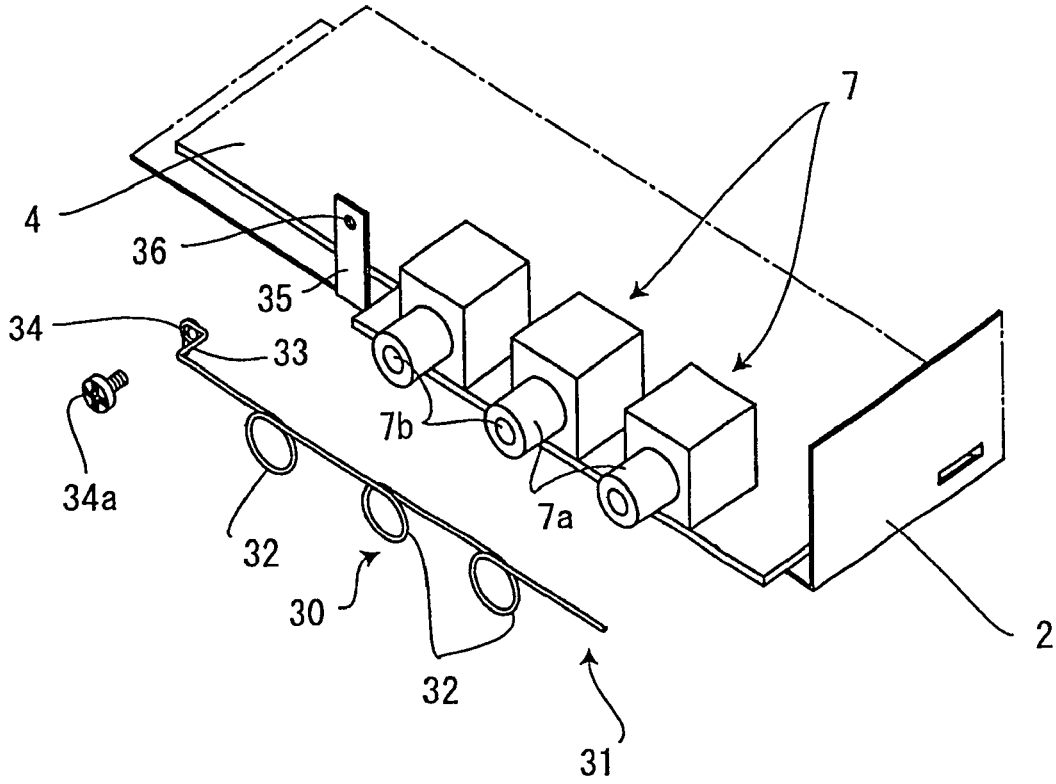

[Fig. 8]
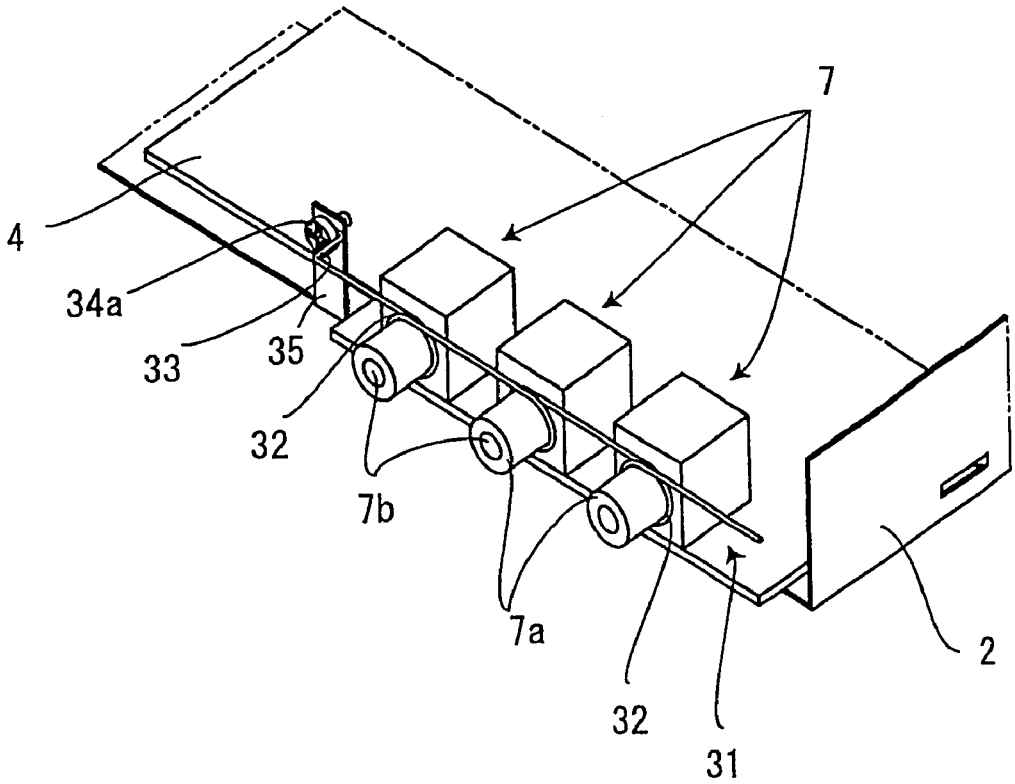

[Fig. 9]
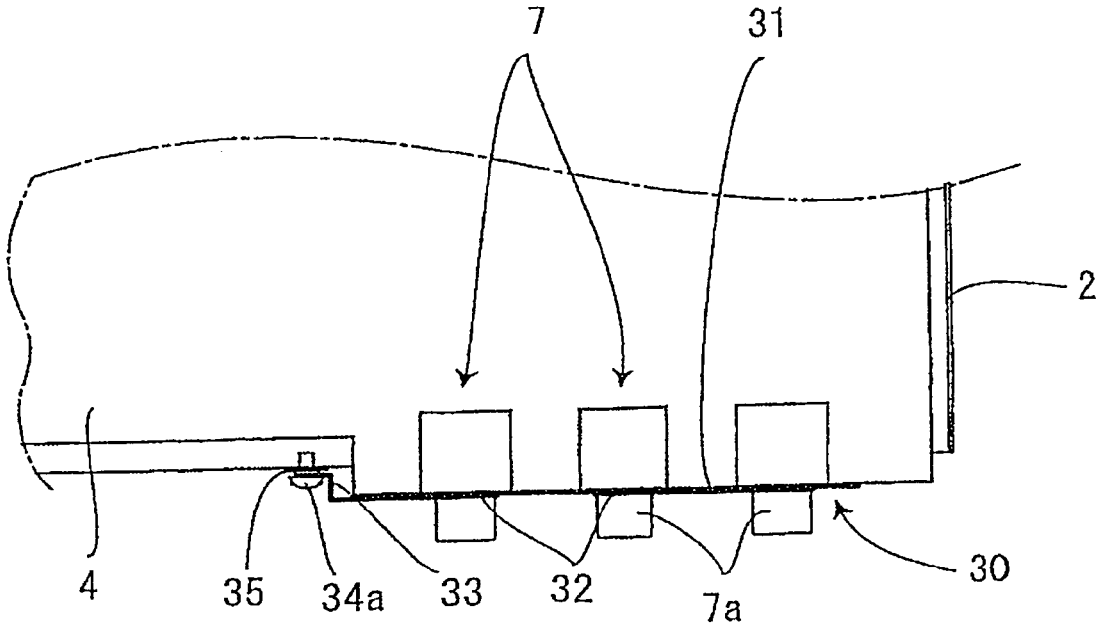
(a)
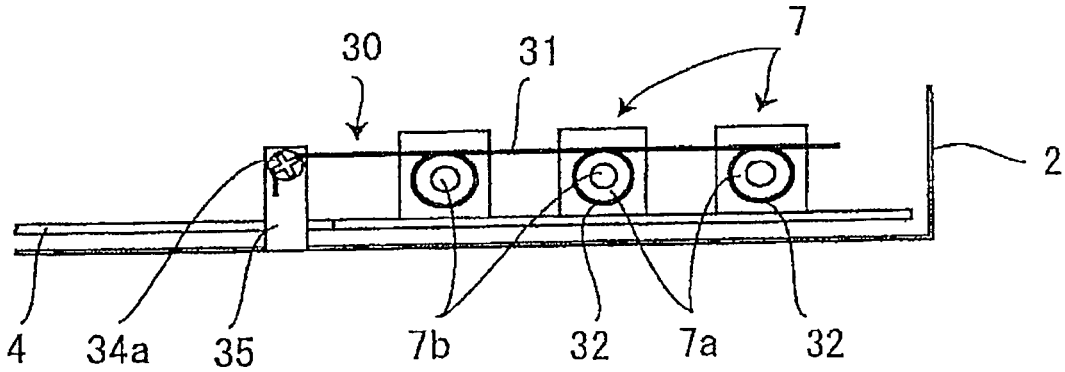
(b)

ELECTRONIC APPARATUS WITH JACK

BACKGROUND OF THE INVENTION

1. Field of the Invention

The present invention relates to an electronic apparatus equipped with a jack. More specifically, the present invention relates to an electronic apparatus equipped with a jack and configured to ground the jack so as to discharge static electricity with which the jack is charged.

2. Description of the Related Art

Generally, an information recording and reproducing apparatus such as a television receiver or a DVD player includes a jack as a terminal to be connected to an external apparatus. The jack of this type is designed to discharge static electricity, with which the jack is charged, by grounding the jack so as to prevent undesired radiation (electromagnetic interference or EMI). Japanese Patent Application Laid-Open No. 11-121105, for example, discloses a jack with a grounding metal configured as follows. The grounding metal is interposed between the jack and a terminal panel. A plurality of inner plate springs elastically contacting with a cylindrical portion of the jack are formed on an inner circumferential surface of a circular hole formed in the grounding metal. An outer plate spring formed on an outside of the grounding metal is contacted with an inside of the terminal panel to contact the jack with the terminal panel. Static electricity with which the jack is charged is thereby discharged from the grounding metal to the terminal panel.

However, the invention disclosed in Japanese Patent Application Laid-Open No. 11-121105 has the following disadvantages. The circular hole is formed in the thin plate-shaped grounding metal, and a plurality of inner plate springs are formed on the inner circumferential surface of the circular hole in order to contact with the cylindrical portion of the jack. In addition, the outer plate spring contacted with the inside of the terminal panel from an outer edge of the grounding metal is formed. Due to this, machining process is complicated. The television receiver, the DVD player or the like, in particular, has a plurality of jacks provided on a circuit board. It takes lots of labor and time to attach grounding metals to the respective jacks, resulting in inferior formability. Further, if the grounding metal is attached or detached, there is a probability of a reduction in a spring property of the inner springs or the outer spring contacted with the jack or the terminal panel. As a result, a contact pressure of the grounding metal cannot be kept in an appropriate state, which possibly makes it difficult to ensure contacting the grounding metal with the jack or the terminal panel.

SUMMARY OF THE INVENTION

The present invention has been achieved to solve the conventional disadvantages. It is an object of the present invention to provide an electronic apparatus with a jack capable of ensuring facilitating formation and ensuring connection of the jack to a ground portion.

According to a first aspect of the present invention, there is provided an electronic apparatus with a jack, including: a conductive jack to be connected to an external apparatus; a circuit board on which the jack is mounted; and a flexible grounding wire that connects the jack to a ground portion, wherein a part of the grounding wire is connected to the ground portion, and a winding portion elastically and closely attached to at least an outer circumference of the jack is formed on the grounding wire.

According to the first aspect of the invention, the part of the grounding wire is connected to the ground portion while the winding portion formed on the grounding wire is elastically and closely attached to the jack. The static electricity, with which the jack is charged, is thereby discharged from the grounding wire to the ground portion. Therefore, the static electricity is not carried to an external apparatus when the external apparatus is connected to the jack.

According to a second aspect of the present invention, there is provided the electronic apparatus with the jack according to the first aspect, wherein the ground portion consists of a ground pattern formed on the circuit board, and a connection end of the grounding wire is connected to the ground pattern.

According to the second aspect of the invention, the static electricity, with which the jack is charged, is discharged from the grounding wire to the ground pattern formed on the circuit board. Therefore, the static electricity is not carried to an external apparatus when the external apparatus is connected to the jack.

According to a third aspect of the present invention, there is provided the electronic apparatus with the jack according to the second aspect, wherein the grounding wire includes: the connection end connected to the ground pattern; a rising portion bent upward from the connection end through a horizontal proximal portion; and a horizontal portion bent from an upper end of the rising portion so as to be parallel to the circuit board, and wherein the winding portion is formed in the horizontal portion into a shape of a coil so as to be smaller in diameter than at least the outer circumference of the jack.

According to the third aspect of the invention, the winding portion formed on the grounding wire is expanded and outwardly engaged to the jack, thereby elastically and closely attaching the winding portion to the jack by an elastic restoring force of the winding portion. While the winding portion of the grounding wire is closely attached to the jack, the connection end bent from the end of the horizontal proximal portion is inserted into the hole formed in the circuit board, and soldered onto the ground pattern formed on a rear surface of the circuit board. The static electricity, with which the jack is charged, is thereby discharged from the grounding wire to the ground pattern formed on the circuit board.

According to a fourth aspect of the present invention, there is provided the electronic apparatus with the jack according to the second aspect, wherein the grounding wire consists of a torsion spring having a coil between a rising portion and a horizontal portion, the winding portion is formed on the horizontal portion into a shape of a coil so as to be smaller in diameter than at least the outer circumference of the jack, the connection end connected to the ground pattern is formed to be bent from the rising portion, and a notch is formed in the circuit board so as to stop the rising portion.

According to the fourth aspect of the invention, the winding portion formed on the grounding wire is expanded and outwardly engaged to the jack, and elastically and closely attached to the jack by the elastic restoring force of the winding portion. The rising portion is then caught in and stopped by the notch of the circuit board so as to flexibly bend the coil formed between the rising portion and the horizontal portion. The rising portion is thereby stopped by the notch of the circuit board by the elastic restoring force of the coil. In this state, by soldering the connection end of the rising portion to the ground pattern, the static electricity, with which the jack is charged, is discharged from the grounding wire to the ground pattern.

According to a fifth aspect of the present invention, there is provided the electronic apparatus with the jack according to the first aspect, wherein the ground portion consists of a conductive chassis assembled with the circuit board, and a connection end of the grounding wire is fixed to the chassis by a fixture.

According to the fifth aspect of the invention, the static electricity, with which the jack is charged, is discharged from the grounding wire to the conductive chassis. Therefore, the static electricity, with which the jack is charged, is not carried to an external apparatus when the external apparatus is connected to the jack.

According to a sixth aspect of the present invention, there is provided the electronic apparatus with the jack according to the fifth aspect, wherein the grounding wire includes a horizontal portion in parallel to the circuit board, the winding portion is formed on the horizontal portion into a shape of a coil so as to be smaller in diameter than at least the outer circumference of the jack, a connection piece connected to the grounding wire is formed to be bent on the chassis, an attachment portion to be arranged along the connection piece is bent from one end of the horizontal portion, a ring portion, into which a screw serving as the fixture is inserted, is formed on the attachment portion, and the screw is mated with the connection piece, thereby grounding the jack.

According to the sixth aspect of the invention, the winding portion formed on the grounding wire is expanded and outwardly engaged to the jack, and elastically and closely attached to the jack by the elastic restoring force of the winding portion. The screw is then inserted into the ring portion formed on the attachment portion, and mated with the screw hole of the connection piece formed on the chassis. The static electricity, with which the jack is charged, is thereby discharged from the grounding wire to the chassis.

According to a seventh aspect of the present invention, there is provided the electronic apparatus with the jack according to the second, third, fourth and sixth aspects, wherein a plurality of jacks are provided in parallel on the circuit board, and a plurality of winding portions elastically and closely attached to outer circumferences of the jacks, respectively are formed on the horizontal portion of the grounding wire.

According to the seventh aspect of the invention, if the winding portions formed on the grounding wire are expanded and outwardly engaged to the respective jacks mounted on the circuit board, then the respective jacks are made conductive by the grounding wire, grounded through the grounding wire, and not charged with the static electricity.

According to the electronic apparatus with the jack according to the first aspect of the present invention, it is possible to ensure connecting the grounding wire to the jack by the elastic restoring force of the winding portion, thereby facilitating assembling the grounding wire with the jack. Since the grounding wire is formed simply by bending the conductive wire, the grounding wire is excellent in formability, and it is possible to ensure that the static electricity, with which the jack is charged, is discharged to the ground portion despite this simple structure. Besides, external static electricity can be prevented from being carried into the electronic apparatus through the jack, and the electronic component arranged in the apparatus can be prevented from being damaged.

According to the electronic apparatus with the jack according to the second aspect of the present invention, it is possible to ensure discharging the static electricity, with which the jack is charged, to the ground pattern formed on the circuit board despite the simple structure of the grounding wire formed by bending the conductive wire.

According to the electronic apparatus with the jack according to the third aspect of the present invention, even if a slight error occurs in the positional relationship between the jack and the ground portion, the error can be absorbed because of the flexibility of the grounding wire itself.

According to the electronic apparatus with the jack according to the fourth aspect of the present invention, if the rising portion is caught in the notch of the circuit board, it is possible to ensure that the rising portion is stopped by the notch of the circuit board by the urging force of the coil. It is, therefore, possible to ensure that the grounding wire is held on the circuit board without being detached therefrom when the connection end is soldered onto the ground pattern.

According to the electronic apparatus with the jack according to the fifth aspect of the present invention, it is possible to ensure discharging the static electricity, with which the jack is charged, to the conductive chassis assembled with the circuit board despite the simple structure of the grounding wire formed by bending the conductive wire.

According to the electronic apparatus with the jack according to the sixth aspect of the present invention, it is possible to ensure connecting the grounding wire to the chassis by the screw. Since the grounding wire is fixed to the chassis by the screw, it is easy to perform an assembly operation.

According to the electronic apparatus with the jack according to the seventh aspect of the present invention, a plurality of jacks mounted on the circuit board can be grounded to one grounding wire.

BRIEF DESCRIPTION OF THE DRAWINGS

FIG. 1 is a perspective view of an electronic apparatus according to a first embodiment of the present invention;

FIGS. 2A and 2B are perspective views that depict a detachment state and an attachment state of a grounding wire shown in FIG. 1, respectively;

FIGS. 3A and 3B are a plan view and a front view that depict attachment states of the grounding wire shown in FIG. 1, respectively;

FIG. 4 is an exploded perspective view of a grounding wire according to a second embodiment of the present invention;

FIG. 5 is a perspective view that depicts an attachment state of the grounding wire shown in FIG. 4;

FIGS. 6A and 6B are a plan view and a front view that depict attachment states of the grounding wire shown in FIG. 4, respectively;

FIG. 7 is an exploded perspective view of a grounding wire according to a third embodiment of the present invention;

FIG. 8 is a perspective view that depicts an attachment state of the grounding wire shown in FIG. 7; and FIGS. 9A and 9B are a plan view and a front view that depict attachment states of the grounding wire shown in FIG. 7, respectively.

DESCRIPTION OF THE PREFERRED EMBODIMENTS

The most preferred embodiment, i.e., a first embodiment of the present invention will be described hereinafter with reference to FIGS. 1 to 3. In the embodiment, an instance in which the present invention is applied to a DVD player serving as an electronic apparatus with a jack will be described. Needless to say, the present invention is easily applicable to electronic apparatus having configurations other than those described in the embodiment within the scope of the concept of the present invention.

[First Embodiment]

FIG. 1 is a perspective view of a DVD player serving as an electronic apparatus 1 according to the first embodiment of the present invention. In this embodiment, an instance in which the DVD player constitutes a part of a multifunction machine configured so that the DVD player is incorporated into the other apparatus such as a television receiver will be described. Alternatively, the DVD player can be employed solely. As shown in FIG. 1, the electronic apparatus 1 is configured so that a recording and reproducing apparatus 3 and a circuit board 4 are incorporated into a conductive chassis 2, and so that a metal cover 5 is fixed onto the conductive chassis 2 so as to cover the recording and reproducing apparatus 3 with the cover 5. An electronic component 6 such as a transformer is mounted on the circuit board 4, and a plurality of jacks 7 that connect the electronic apparatus 1 to an external apparatus are mounted on a front end of the circuit board 4. Each of these jacks 7 includes a conductive cylindrical portion 7*a* having a plug insertion hole 7*b* formed in a central portion thereof. A flexible grounding wire 10 is attached to the cylindrical portions 7*a*, and one end of this grounding wire 10 is connected to a ground pattern 4*a* formed on the circuit board 4 as a ground portion.

Referring next to FIGS. 2A, 2B, 3A, and 3B, a structure of the grounding wire 10 according to this embodiment will be described in detail. The grounding wire 10 is formed by bending a wire consisting of a conductive material. Winding portions 12 are formed on a horizontal portion 11 of the grounding wire 10 parallel to the circuit board 4 into the shape of coils so as to be smaller in diameter than an outer circumference of the cylindrical portion 7*a* of each jack 7 mounted on the circuit board 4. The number of winding portions 12 corresponds to the number of jacks 7 mounted on the circuit board 4. In addition, a connection end 15 and a rising portion 16 are formed on the end of the grounding wire 10. Specifically, the connection end 15 to be inserted into a hole 4*b* formed in the ground pattern 4*a* is formed on one end of a horizontal proximal portion 13 of the grounding wire 10 in parallel to the circuit board 4 to be bent downward, in order to connect the grounding wire 10 to the ground pattern 4*a* formed on the circuit board 4. The rising portion 16 is formed on the other end of the horizontal proximal portion 13 so as to be continuous to the horizontal portion 11.

According to this embodiment of the electronic apparatus 1 thus configured, the winding portions 12 formed on the grounding wire 10 are expanded and outwardly engaged to the cylindrical portions 7*a* of the jacks 7, respectively. The winding portions 12 are thereby elastically and closely attached to the cylindrical portions 7*a* of the respective jacks 7 by elastic restoring forces of the winding portions 12. While the winding portions 12 of the grounding wire 10 are closely attached to the cylindrical portions 7*a* of the respective jacks 7, the connection end 15 bent from one end of the horizontal proximal portion 13 is inserted into the hole 4*b* formed in the circuit board 4 and soldered onto the ground pattern 4*a* formed on a rear surface of the circuit board 4. It is thereby possible to ensure that static electricity, with which the jacks 7 are charged, is discharged from the grounding wire 10 to the ground pattern 4*a*. In addition, it is possible to prevent an influence of the static electricity on the external apparatus without flowing the static electricity into the external apparatus when the external apparatus is connected to the plug insertion hole 7*b* of each jack 7.

As can be seen, according to this embodiment, the winding portions 12 in the shape of coils are formed on the flexible grounding wire 10 so as to be smaller in diameter than the outer circumference of the cylindrical portion 7*a* of each jack 7. Only by expanding and outwardly engaging the winding portions 12 to the cylindrical portions 7*a* of the respective jacks 7, the winding portions 12 are brought into elastic contact with the cylindrical portions 7*a* of the jacks 7 by the elastic restoring forces of the winding portions 12, and the grounding wire 10 is connected to the jacks 7. Further, the connection end 15 of the grounding wire 10 attached to the jacks 7 is inserted into the hole 4*b* formed in the circuit board 4 and soldered onto the ground pattern 4*a* formed on the circuit board 4. It is thereby possible to ground the jack 7 to the ground pattern 4*a* through the grounding wire 10. Since the grounding wire 10 consists of a thin wire per se, the horizontal proximal portion 13 is easily elastically deformed. This can facilitate assembling the grounding wire 10 with the jacks 7. In addition, even if a slight error occurs in the positional relationship between the jacks 7 mounted on the circuit board 4 and the hole 4*b* formed in the circuit board 4, the error can be absorbed because of the flexibility of the grounding wire 10. Furthermore, since the grounding wire 10 is formed simply by bending the conductive wire, the grounding wire 10 is excellent in formability, and it is possible to ensure that the static electricity, with which the jacks 7 are charged, is discharged to the ground pattern 4*a* of the circuit board 4 despite such a simple structure. Besides, external static electricity can be prevented from being carried into the electronic apparatus 1 through the jacks 7, and the electronic component 6 arranged in the apparatus 1 can be prevented from being damaged.

[Second Embodiment]

FIGS. 4 to 6A and 6B show a second embodiment of the present invention. In the second embodiment, elements having the same functions as those according to the first embodiment are denoted by the same reference symbols, respectively and will not be described herein repeatedly. In this embodiment, only different elements will be described. According to this embodiment, a grounding wire 20 consists of a torsion spring having a coil 23 formed between a rising portion 21 and a horizontal portion 22. Winding portions 25 in the shape of coils are formed on the horizontal portion 22 so as to be smaller in diameter than the outer circumference of the cylindrical portion 7*a* of each jack 7. On one end of the grounding wire 20, a connection end 26 is formed to be bent from the rising portion 21 so as to be connected to the ground pattern 4*a* of the circuit board 4. In addition, a notch 7*c* is formed on a front edge of the circuit board 4 so as to stop the rising portion 21. By causing the notch 7*c* to stop the rising portion 21 of the grounding wire 20 while the coil 23 is flexibly bent, the rising portion 21 is held on the circuit board 4 in a state in which the connection end 26 is in contact with the ground pattern 4*a*.

According to this embodiment of the electronic apparatus 1 thus configured, the winding portions 25 formed on the grounding wire 20 are expanded and outwardly engaged to the cylindrical portions 7*a* of the respective jacks 7, and elastically and closely attached to the cylindrical portions 7*a* of the jacks 7 by elastic restoring forces of the winding portions 25. Thereafter, the rising portion 21 is stopped by the notch 7*c* of the circuit board 4 so as to be caught in the notch 7*c* while flexibly bending the coil 23 formed between the rising portion 21 and the horizontal portion 22. It is thereby possible to ensure that the rising portion 21 is stopped by the notch 7*c* of the circuit board 4 by elastic restoring force of the coil 23. In this state, the connection end 26 of the rising portion 21 is soldered onto the ground pattern 4*a*. It is thereby possible to ensured is charging the static electricity, with which the jacks 7 are charged, from the grounding wire 20 to the ground pattern 4*a*. This can prevent the influence of the static electricity on the external apparatus connected to the jacks 7. Further, it is possible to ensure that the winding portions 25 of the grounding wire 20 are in contact with the cylindrical portions 7*a* of the respective jacks 7 by the elastic restoring force of the grounding wire 20. Further, when the rising portion 21 is caught in the notch 7*c* of the circuit board 4 and the connection end 26 bent from the end of the rising portion 21 is soldered onto the ground pattern 4*a*, it is possible to ensure that the rising portion 21 is stopped by the notch 7*c* of the circuit board 4 by an urging force of the coil 23. It is, therefore, possible to ensure that the grounding wire 20 is held on the circuit board 4 without being detached therefrom when the connection end 26 is soldered onto the ground pattern 4*a*.

[Third Embodiment]

FIGS. 7 to 9A and 9B show a third embodiment of the present invention. In the third embodiment, elements having the same functions as those according to the first and the second embodiments are denoted by the same reference symbols, respectively and will not be described herein repeatedly. In this embodiment, only different elements will be described. In the first and the second embodiments, the instance in which the jacks 7 are grounded by connecting the grounding wire 10 or 20 to the ground pattern 4*a* of the circuit board 4 has been described. In this embodiment, an instance in which the jacks 7 are grounded by connecting a grounding wire 30 to the conductive chassis 2 will be described.

Namely, similarly to the first and the second embodiments, the grounding wire 30 according to this embodiment includes a horizontal portion 31 in parallel to the circuit board 4. Winding portions 32 in the shape of coils are formed on this horizontal portion 31 so as to be smaller in diameter than at least the outer circumference of the cylindrical portions 7*a* of the respective jacks 7. An attachment portion 33 is formed to be bent from one end of the horizontal portion 31, and a ring portion 34 into which a screw 34*a* serving as a fixture is inserted is formed on this attachment portion 33. A connection piece 35 is formed on a front edge of the chassis 2, and a screw hole 36 mated with the screw 34*a* is formed in this connection piece 35.

According to the embodiment of the electronic apparatus 1 thus configured, similarly to the preceding embodiments, the winding portions 32 formed on the grounding wire 30 are expanded and outwardly engaged to the cylindrical portions 7*a* of the respective jacks 7, and elastically and closely attached to the cylindrical portions 7*a* of the jacks 7 by the elastic restoring forces of the winding portions 32. Thereafter, the screw 34*a* is inserted into the ring portion 34 formed on the attachment portion 33 and then mated with the screw hole 36 of the connection piece 35 formed to be bent on the front edge of the chassis 2. It is thereby possible to ensure discharging the static electricity, with which the jacks 7 are charged, from the grounding wire 30 to the chassis 2. This can prevent the influence of the static electricity on the external apparatus connected to the jacks 7 similarly to the preceding embodiments. Besides, this embodiment can dispense with the soldering operation required in the first and the second embodiments because of the connection of the grounding wire 30 to the chassis 2 by the screw 34*a*.

The embodiments of the present invention have been described in detail so far. However, the present invention is not limited to the respective embodiments but can be variously changed and modified within the scope of the concept of the present invention. For instance, the shape of the grounding wire may be arbitrarily set. In addition, the DVD player serving as the electronic apparatus 1 has been shown in the embodiments. However, the present invention is not limited to the DVD player and widely applicable to various other electronic apparatuses.

What is claimed is:

1. An electronic apparatus with a jack, comprising:

a conductive jack to be connected to an external apparatus;

a circuit board on which the jack is mounted; and a flexible grounding wire that connects the jack to a ground portion, wherein a part of the grounding wire is connected to the ground portion, and a winding portion elastically and closely attached to at least an outer circumference of the jack is formed on the grounding wire.

2. The electronic apparatus with the jack according to claim 1, wherein the ground portion consists of a ground pattern formed on the circuit board, and a connection end of the grounding wire is connected to the ground pattern.

3. The electronic apparatus with the jack according to claim 2, wherein the grounding wire comprises:

the connection end connected to the ground pattern;

a rising portion bent upward from the connection end through a horizontal proximal portion; and a horizontal portion bent from an upper end of the rising portion so as to be parallel to the circuit board, and wherein the winding portion is formed in the horizontal portion into a shape of a coil so as to be smaller in diameter than at least the outer circumference of the jack.

4. The electronic apparatus with the jack according to claim 2, wherein the grounding wire consists of a torsion spring having a coil between a rising portion and a horizontal portion, the winding portion is formed on the horizontal portion into a shape of a coil so as to be smaller in diameter than at least the outer circumference of the jack, the connection end connected to the ground pattern is formed to be bent from the rising portion, and a notch is formed in the circuit board so as to stop the rising portion.

5. The electronic apparatus with the jack according to claim 1, wherein the ground portion consists of a conductive chassis assembled with the circuit board, and a connection end of the grounding wire is fixed to the chassis by a fixture.

6. The electronic apparatus with the jack according to claim 5, wherein the grounding wire comprises a horizontal portion in parallel to the circuit board, the winding portion is formed on the horizontal portion into a shape of a coil so as to be smaller in diameter than at least the outer circumference of the jack, a connection piece connected to the grounding wire is formed to be bent on the chassis, an attachment portion to be arranged along the connection piece is bent from one end of the horizontal portion, a ring portion, into which a screw serving as the fixture is inserted, is formed on the attachment portion, and the screw is mated with the connection piece, thereby grounding the jack.

7. The electronic apparatus with the jack according to claim 2, wherein a plurality of jacks are provided in parallel on the circuit board, and a plurality of winding portions elastically and closely attached to outer circumferences of the jacks, respectively are formed on the horizontal portion of the grounding wire.

8. The electronic apparatus with the jack according to claim 3, wherein a plurality of jacks are provided in parallel on the circuit board, and a plurality of winding portions elastically and closely attached to outer circumferences of the jacks, respectively are formed on the horizontal portion of the grounding wire.

9. The electronic apparatus with the jack according to claim 4, wherein a plurality of jacks are provided in parallel on the circuit board, and a plurality of winding portions elastically and closely attached to outer circumferences of the jacks, respectively are formed on the horizontal portion of the grounding wire.

10. The electronic apparatus with the jack according to claim 6, wherein a plurality of jacks are provided in parallel on the circuit board, and a plurality of winding portions elastically and closely attached to outer circumferences of the jacks, respectively are formed on the horizontal portion of the grounding wire.

* * * * *